United States Patent [19]

Floyd et al.

[11] Patent Number: 4,503,593

[45] Date of Patent: Mar. 12, 1985

[54] STUFFER BOX CRIMPER

[75] Inventors: Terry S. Floyd, Clover; James A. Williams, Van Wyck, both of S.C.

[73] Assignee: Celanese Corporation, New York, N.Y.

[21] Appl. No.: 455,096

[22] Filed: Jan. 3, 1983

[51] Int. Cl.[3] ..... D02G 1/12

[52] U.S. Cl. ..... 28/263

[58] Field of Search ..... 28/262, 263; 26/1, 18.6

[56] References Cited

U.S. PATENT DOCUMENTS

| | | | |
|---|---|---|---|
| 1,978,407 | 10/1934 | Cadgene | 28/263 X |
| 2,115,313 | 4/1938 | Matthew et al. | 28/262 |
| 2,647,285 | 8/1953 | Pfau | 28/262 X |
| 3,390,218 | 6/1968 | Painter et al. | 26/18.6 X |
| 4,142,278 | 3/1979 | Walton et al. | 26/18.6 |

*Primary Examiner*—Robert R. Mackey

*Attorney, Agent, or Firm*—Robert J. Blanke

[57] ABSTRACT

An improved stuffer box crimping apparatus of the type in which tow is fed into a rectangular cross-section crimping chamber off-set from the bite of a pair of feed rolls, the apparatus employing a crimping chamber wherein one wall is predominantly formed by a single doctor blade and an opposite wall is formed by a portion of the rotating surface of one of the cylindrical feed rolls of the feed roll pair, the doctor blade being pivotally mounted on the feed roll nearest the tip portion of the doctor blade. The cross-sectional area of the crimping chamber diminishes toward the exit portion thereof, whereby crimped filamentary material within the crimping chamber is subjected to both back pressure and a constant forwarding action by the rotating surface of the cylindrical feed roll. The pivotal mounting of the doctor blade provides precise clearance and allows the volume of the crimping chamber to adjust in accordance with tow variations.

9 Claims, 8 Drawing Figures

STUFFER BOX CRIMPER

This invention relates to the treatment of filamentary material and more particularly to a method and apparatus for imparting crimp to a bundle or tow of continuous filaments. In particular, this invention relates to stuffer box crimping.

BACKGROUND OF THE INVENTION

In the process for conventional stuffer box crimping, a continuous product of filamentary material (hereinafter referred to as a "tow") is passed through a pair of nip rolls which forcibly feed the tow into a confined passage from which its emergence is resisted so that the tow assumes a crimped or buckled form and is subjected to a substantial degree of pressure by subsequently entering portions of the tow thereby fixing the crimp and causing it to be retained in the tow subsequent to its emergence from the confined passage.

Representative apparatus for conventional stuffer box crimping is disclosed in U.S. Pat. Nos. 2,156,723; 2,693,008; 2,862,279 and 3,571,870.

Such apparatus generally comprises a pair of cylindrical feed rolls mounted to form a nip and a crimping chamber positioned in close proximity to the point where the tow exits from the nip. The crimping chamber conventionally comprises two oppositely positioned doctor blades maintained near or against the surface of the cylindrical feed rolls as they rotate past the nip point and forming the entrance to the chamber, two side or cheek plates to confine the lateral movement of the tow in the chamber and a confining means at the exit of the crimping chamber to provide resistance to the forward movement of the tow.

The confining means may be an adjustable positioned flap or gate as in the above mentioned U.S. Pat. No. 2,693,008 or may be the outer end of one of the doctor blades of the chamber which is pivotally mounted to permit an increase or decrease in the space between the blades at the exit end of the chamber as disclosed in the aforementioned U.S. Pat. Nos. 2,156,723; 2,862,279 and 3,571,870.

In the case of any of this apparatus, the nature of the crimp imparted to the strand is a function of the size of the crimping chamber and, in particular, the depth of the chamber which is determined by the distance which the doctor blades are positioned away from each other. When the doctor blades are positioned relatively close together, they form a shallow crimping chamber which will induce a multiplicity of small, relatively uniform crimps. When the doctor blades are positioned relatively far apart, they form a relatively large, or deep, crimping chamber which will produce predominantly large but also less uniform crimps in a tow. A relatively small crimping chamber would, therefore, usually be preferred for most crimping operations and particularly for those in which uniformity of crimp is of primary importance.

However, since the edges of the doctor blades forming the entrance to the crimping chamber must be maintained against or at least in close proximity with the cylindrical surfaces of the feed rolls, a shallow or small crimping chamber with the doctor blades relatively close together requires the use of relatively small feed rolls to avoid having to place the crimping chamber far into the nip of the feed rolls in order to obtain contact between the closely spaced apart doctor blades and the corresponding surfaces of the feed rolls.

The utilization of small feed rolls is not generally preferred in any feeding operation since the smaller feed rolls present a smaller surface area for wear, necessitate higher rotational speeds to obtain equivalent feed and, in the case of a crimping apparatus, make the installation and maintenance of the chamber side or cheek plates difficult. Therefore, a conventional small stuffer box crimper could be utilized with large feed rolls only by utilizing long, extremely narrow doctor blades which would fit deep into the nip of the two large diameter rolls. These doctor blades are difficult to produce and easily damaged. Furthermore, such a crimping chamber is difficult to position against the feed rolls because of the nature of the doctor blades but, moreover, because the entire chamber is ultimately positioned far in toward the nip of the rolls. This position additionally makes access to the chamber for servicing difficult. As a result, conventional stuffer box crimping apparatus generally utilizes cylindrical feed rolls which have a diameter equal to from about 15 to about 40 times the depth of the crimping chamber.

The foregoing discussion has centered on stuffer box crimpers having a crimping chamber in line with the bite of the feed rolls. Such conventional stuffer box crimpers crimp tow in what is best described as a stick-slip motion. Stuffer box crimping apparatus however, exists wherein the crimping chamber is offset with the bite of the feed rolls. Offset stuffer-box crimpers are known to reduce damage to the fiber being crimped and moreover to affect a high degree of uniformity in the crimped product. This improvement is at least partially due to preventing stick-slip motion in the crimping process. U.S. Pat. No. 2,917,784 for instance, discloses in FIG. 13 thereof a stuffer box crimper having an offset crimping chamber formed by a fixed curved doctor blade and a floating feed roll. Back pressure is provided by means of a pivoted flapper. The curved doctor blade is curved so that the cross-section of the crimping chamber is relieved away from its entrance by being tapered slightly outwardly in that direction, usually about two to six degrees. In other words, the depth of the crimping chamber increases toward the exit portion thereof. A second scrapper blade may optionally be used to remove the crimped tow from the floating roll.

U.S. Pat. No. 3,146,512 employs a conventional feed roll pair with a stuffer box offset from the bite thereof. The salient feature of U.S. Pat. No. 3,146,512 is the use of a grooved doctor blade which connects with a circumferential groove of an abutting wheel member. U.S. Pat. No. 3,146,512 does not disclose a rectangular cross-section crimping chamber, but rather relies upon an elongated crimping chamber having a unique cross-sectional configuration designed to trap and prevent premature release of filamentary material.

U.S. Pat. No. 3,441,988 employs a curved doctor blade which at least partially surrounds the external surface of a roller to produce a gap-forming segment or crimping chamber. Filaments are fed into the zone and their exit is restrained by a retarding means positioned at the exit of the zone. U.S. Pat. No. 3,441,988 however, cannot be construed as a stuffer-box crimper in the classic sense inasmuch as it does not crimp tow issuing from the bite of a feed roll pair.

None of the foregoing patents disclose a two roll feed system offset stuffer box crimper wherein yarn is set in the crimped configuration within a rectangular cross-section crimping chamber formed by means of a curved doctor blade which converges toward one of the feed rolls and wherein the cross-sectional area of the crimping chamber diminishes toward the exit portion thereof.

SUMMARY OF THE INVENTION

In accordance with the present invention, there is provided an improved stuffer box crimper of the type in which tow is fed into a rectangular cross-section crimping chamber off-set from the bite of a pair of feed rolls, the improvement comprising forming the crimping chamber from a single doctor blade and a portion of the rotating surface of one of the cylindrical feed rolls, said doctor blade being pivotally mounted to that feed roll which is nearest the tip portion of the doctor blade, the cross-sectional area and depth of the crimping chamber diminishing toward the exit portion thereof. Most preferably, the roll which is not pivotally mounted to the doctor blade has the larger diameter of the feed roll pair.

According to another aspect of the invention, there is provided a process for crimping a tow or bundle of continuous filaments by feeding the strand through a set of nip rolls into a rectangular cross-section crimping chamber formed by a doctor blade and a portion of the rotating surface of one of the nip rolls, said rectangular cross-section of the confining chamber continually diminishing toward the exit portion thereof. Stick-slip motion in the crimping operation is prevented by the continuous wiping action of the roll which forms on face of the crimping chamber. Moreover, by pivotally mounting the doctor blade to that feed roll which forms a part of the crimping chamber, the volume of the crimping chamber will not be substantially affected even though one of the rolls may ride up or down due to variations in the tow being processed.

The apparatus itself, both as to its construction and its mode of operation, together with additional features and advantages thereof as well as the process of the invention, will best be understood subsequent to a discussion of the following specific embodiments with reference to the accompanying drawings.

DESCRIPTION OF THE PREFERRED EMBODIMENTS

Figure 1:
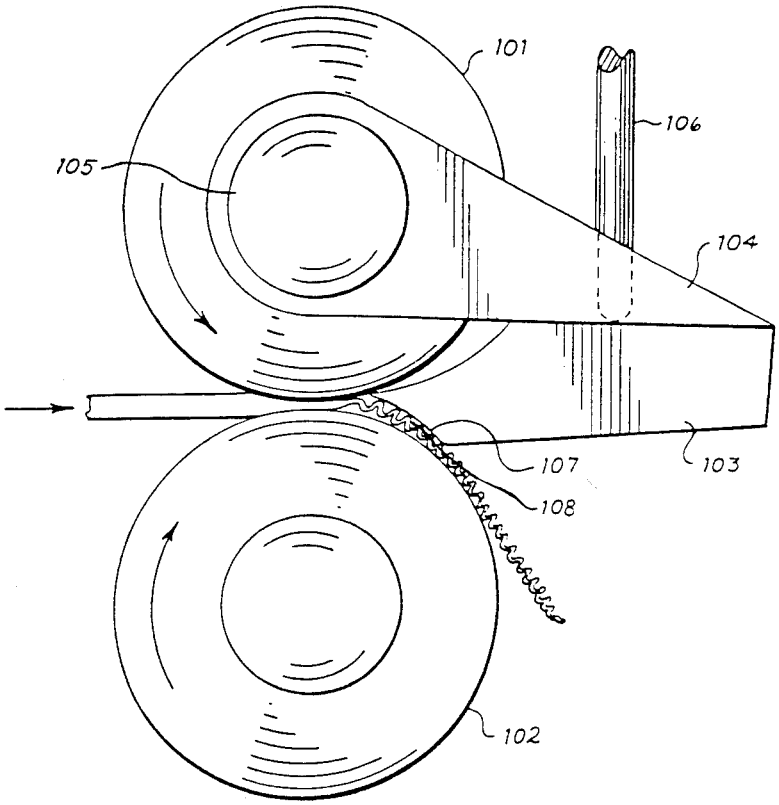
FIG. 1 shows schematically, inside elevation, a band of tow being passed through a crimper of this invention.

Referring to FIG. 1, one form of the apparatus comprises a set of cylindrical feed rolls 101, 102 which are mounted so as to be pressed together to form a nip as by means (not illustrated) of springs under the control of adjusting screws whereby the pressure can be varied and either one or both of which are driven by a driving means (not illustrated) in the direction indicated. A single doctor blade 103, having an arcuate surface 107 is mounted on an arm 104, pivoted about the shaft 105 of the upper feed roll 101, and loaded by means of a pressure rod 106. The doctor blade is positioned to fit closely into the nip between the rolls 101, 102, the arcuate surface of the doctor blade being positioned in a spaced-apart relationship with the cylindrical surface of the lower feed roll 102 to form a confining passage 108 between the arcuate surface of the doctor blade and the cylindrical surface of the feed roll. The tip of the doctor blade is positioned against or in close proximity to the cylindrical surface of the upper feed roll 101 so as to define the opening to the confining passage between the tip of the doctor blade and the surface of the lower feed roll 102 at a point just after the exit of the tow from the nip. For ease of illustration, side or cheek plates of the apparatus have not been shown.

Figure 2:
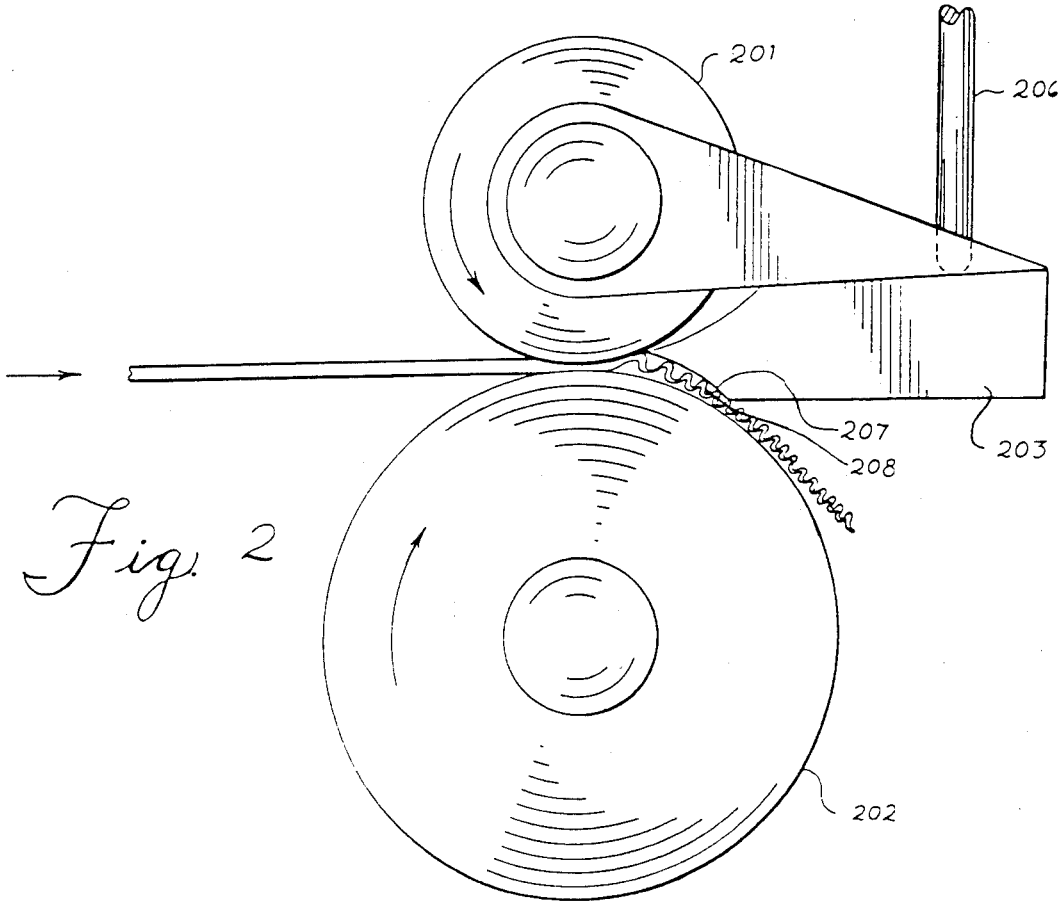
FIG. 2 shows schematically, inside elevation, another embodiment of the crimper of this invention utilizing one large diameter and one small diameter feed roll.

Large diameter feed rolls have generally not been practical in prior art conventional crimping apparatus in that long and narrow doctor blades were necessary to reach into the nip and contact the surface of the rotating feed rolls. In addition to being more difficult to fabricate, the long and narrow doctor blades are more easily damaged and more difficult to correctly position in the nip between the rolls. As a result, small crimping chambers of the prior art conventional stuffer box crimpers are used almost exclusively with small diameter feed rolls because the advantages of using large diameter feed rolls are outweighed by the disadvantages of the prior art doctor blades which must be used in combination with the large feed rolls. However, in the instant invention, as can be seen in FIG. 2 of the drawings, the diameter of one of the feed rolls is easily increased to take advantage of the larger surface area available for wear, lower operating speeds and ease of mounting of rolls and confining side or cheek plates. More specifically, doctor blade 203 is pivotally mounted on upper roll member 201. Doctor blade 203 is positioned to fit closely into the nip between rolls 201 and 202, the arcuate surface 207 of the doctor blade being positioned in a spaced-apart relationship with the cylindrical surface of the lower feed roll 202 to form a confining passage 208 between the arcuate surface of the doctor blade 207 and the cylindrical surface of the feed roll 202. While in the case of FIG. 2, lower feed roll member 202 is larger than upper feed roll member 201, it should be understood that both roll members may be enlarged roll members. In any event however, it is essential that the doctor blade be pivotally mounted to that roll nearest the tip portion of the doctor blade and urged downwardly by suitable means such as pressure rod 206.

Figure 3:
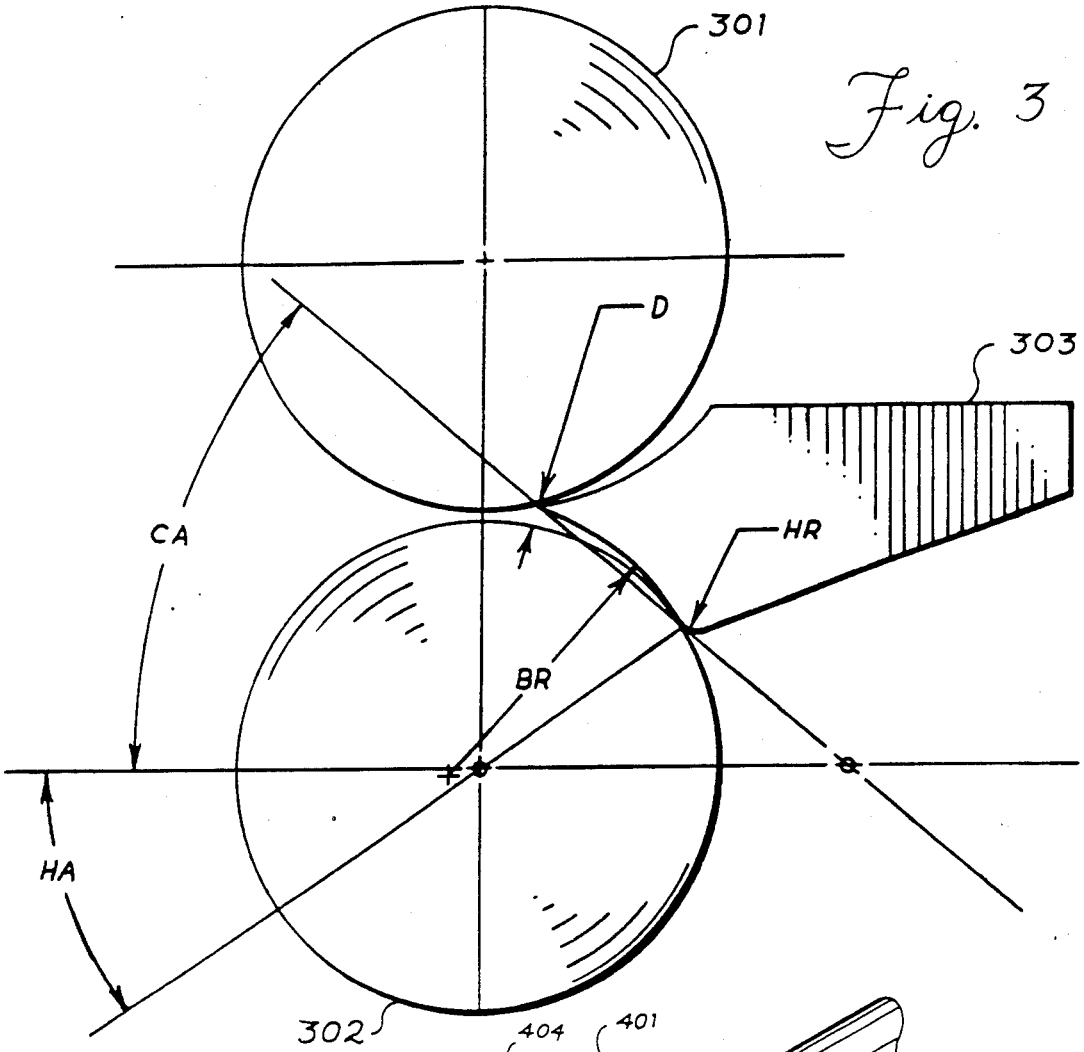
FIG. 3 shows schematically, inside elevation, the critical paramaters of the crimper of this invention.

As previously noted, various dimensions in addition to roll diameters of the apparatus of the instant invention are critical. The roll diameter of the apparatus of this invention may be in the range of from 2 to 7 inches and preferably from 2 to 5 inches. The critical areas, other than roll diameters of the apparatus of the instant invention, may best be described by turning to FIG. 3 of the drawings which schematically illustrates an upper and lower feed roll pair with a doctor blade positioned so as to form a crimping chamber in conjunction with the upper feed roll member 301, lower feed roll member 302 and doctor blade 303. The critical areas are the chamber depth (D), doctor blade radius (BR), doctor blade heel radius (HR), heel contact angle (HA) and convergence angle (CA). As can be seen from FIG. 3 of the drawings, maximum chamber depth is the maximum distance between doctor blade 303 and lower feed roll 302. Doctor blade radius (BR) is the radius of curvuture of the crimping chamber wall forming portion of doctor blade 303 which forms a crimping chamber in conjunction with lower feed roll member 302. Doctor blade heel radius (HR) is the radius of curvuture of the terminal tow contacting portion of doctor blade 303. Convergence angle (CA) is that angle formed by a line drawn through the tip and the heel of doctor blade 303 and the horizontal line passing through the center of lower feed roll 302, the horizontal line forming a 90° angle with a line passing through the center of upper feed roll 301 and lower feed roll 302. Heel contact angle (HA) is that angle formed by a line drawn from the center of lower feed roll member 302 to the heel contact point of that line running from the tip of doctor blade 303 tangent to the heel of doctor blade 303 and a horizontal line passing through the center of lower feed roll member 302, the horizontal line forming a 90° angle with a line passing through the center of upper feed roll 301 and lower feed roll 302.

The following specific ranges have been found to be suitable for the apparatus and process of the instant invention.

| | |
|---|---|
| Maximum chamber depth (D) | .003 to 0.3 inches |
| and preferably | .03 to 0.18 inches |
| Doctor blade radius (BR) | .250 to 3.50 inches |
| and preferably | .250 to 2.50 inches |
| Doctor blade heel radius (HR) | .01 to .50 inches |
| and preferably | .01 to .25 inches |
| Convergence angle (CA) | 20° to 45° |
| and preferably | 30° to 40° |
| Heel contact angle (HA) | 0° to 80° |
| and preferably | 30° to 80° |

Figure 4:
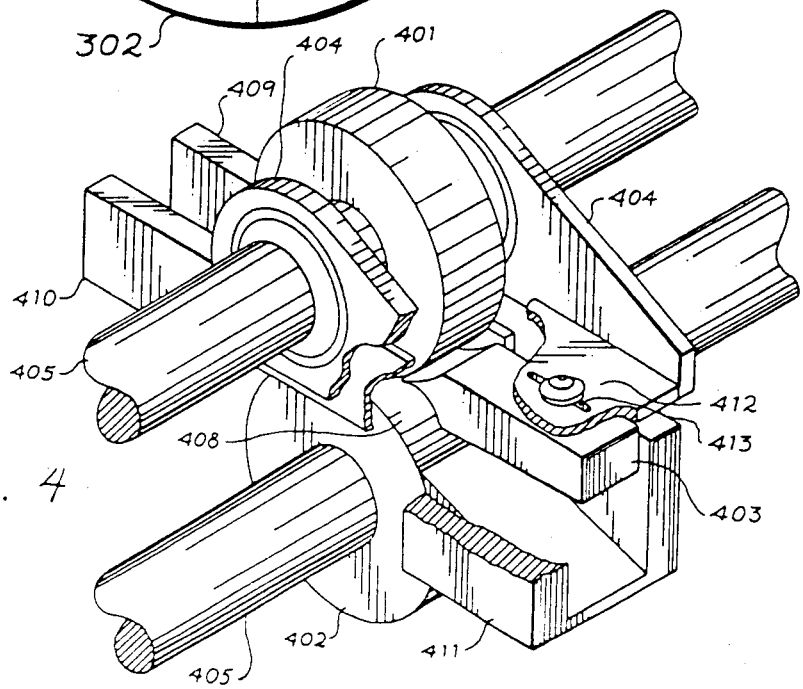
FIG. 4 shows in projected view, not to scale, the crimper of this invention.

A better understanding of the process and apparatus of the instant invention may be had from a discussion of FIG. 4 of the drawings. The method of the instant invention involves feeding a bundle or tow of continuous filaments through the nip of a set of rotating cylindrical feed rolls 401 and 402 into a confining chamber 408 formed by the arcuate surface of doctor blade 403 which is pivotally mounted on swing arms 404 and positioned to fit closely into the nip of feed rolls 401 and 402 and the rotating cylindrical surface of roll 402. Doctor blade 403 is also designed to be top loaded such as to provide a back pressure within chamber 408 to impede the movement of the continuous filaments from the chamber and causing the formation of a crimped tow which is then advanced along and out of the chamber by the rotating cylindrical surface of feed roll 402. Clearance adjustments between doctor blade 403 and feed roll 401 may be made by means of set screw 412 which is mounted in slot member 413. As can be seen, the crimping chamber 408 is rectangular in cross-section, the sides of the rectangular cross-section crimping chamber being formed by side or cheek plate members 409 and 410. Crimping chamber 408 diminishes in cross-section toward the exit portion thereof by causing the tip portion of doctor blade member 403 to be spaced a greater distance from the surface of nip roll member 402 than the heel portion of doctor blade 403. Preferably, the crimped tow exiting from crimping chamber 408 is released from nip roll 402 by means of scraper blade 411 positioned immediately beneath the heel of doctor blade member 403. While not illustrated, either or both of nip roll members 401 and 402 may be driven by suitable power means secured in driving relationship to shaft members 405. While the apparatus and process of this invention are suitable for crimping a wide variety of thermoplastic continuous filament tows, the apparatus and process of the instant invention have special utility when employed in conjunction with cellulose acetate cigarette tow.

As previously noted, the process and apparatus of the instant invention provide a means for minimizing crimp variations and more specifically, minimizing crimp variations in cellulose acetate cigarette tow. It has been found that the process and apparatus of the instant invention will reduce primary crimp coefficient of variation to less than 10. The statistical investigation of the improvement obtained by the use of the apparatus and process of the instant invention is based on F-distribution. In F-distribution, when samples are taken from two independent populations, their variances are also independent and both $S_1^2$ and $S_2^2$ are unbiased estimators of the population variances, if the populations are infinite or if sampling with replacement. That is to say $S_1^2$ is an unbiased estimator of $\sigma_1^2$ (population standard deviation 1) and $S_2^2$ is an unbiased estimator of $\sigma_2^2$ (population standard deviation 2). The ratio of $\sigma_1^2$ to $\sigma_1^2$ is equal to 1.00 if the two variances are equal, and the mean ratio of $S_1^2$ to $S_2^2$ is also equal to 1.00 if the population variances are equal.

If the two populations are both normal and have equal variances, then the ratio of the two sample variance values are distributed as F with $n_1-1$ and $n_2-1$ degrees of freedom.

The term coefficient of variation (CV) is a means for comparing the dispersion of two series by expressing the standard deviation as a percent of the mean of the series. In the instant invention, the mean of the series $\sigma$ is a value encompassing 66% of all samples. The coefficient of variation (CV) may then be defined as follows:

$$CV = \frac{\text{average sample deviation}}{\text{average sample value}} \times 100$$

The following specific examples of crimping cellulose acetate cigarette tow show the improvement in crimp uniformity obtained by the process and apparatus of the invention.

EXAMPLE I

Cellulose acetate tow having an F cross-section, a total denier of 39,000 and a denier per filament of 3.3 is treated in an apparatus of the kind shown in FIG. 4 of the drawings.

The nip roll pressure is maintained at about 390 pounds per square inch and operated at speeds of 397 meters per minute. The downward loading on the doctor blade is adjusted such that slippage of the tow at the nip rolls is approached, but not obtained so that a crimp level of 35.4 crimps per inch is possible. The crimping chamber is cooled with a water/air mist spray to prevent filament fusion.

Figure 7:
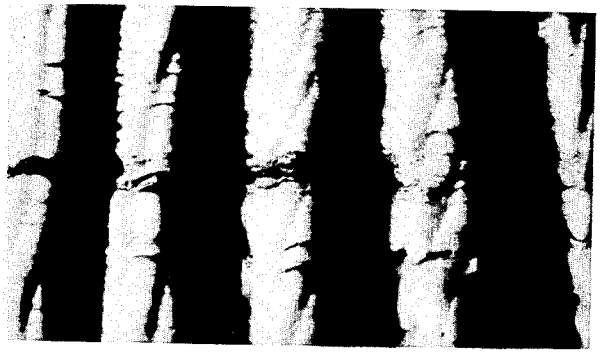
FIG. 7 is a photomicrograph of cellulose acetate tow crimped by the process and apparatus of this invention.
Figure 8:
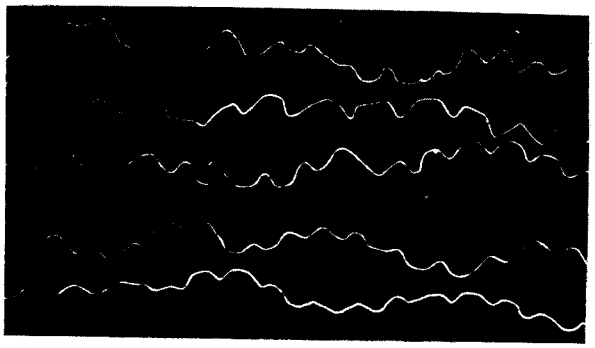
FIG. 8 is a photomicrograph of individual crimped filaments stripped from the tow of FIG. 7.

The crimped tow product which is illustrated in FIG. 7 of the drawings, the individual filament of which is illustrated in FIG. 8 of the drawings, is found to have an average primary crimp of 23.4 crimps per inch and a coefficient of variation of 8.3.

EXAMPLE II

Cellulose acetate tow having an F cross-section, a total denier of 39,000 and a denier per filament of 3.3 is processed in the conventional stuffer box crimping apparatus substantially as illustrated in FIG. 2 of U.S. Pat. No. 2,693,008. A processing speed of about 400 meters per minute is employed. The nip roll pressure is maintained at about 390 pounds per square inch. The flapper is loaded with a pressure of less than 390 pounds per square inch, but sufficient to obtain maximum crimps per inch. The crimping chamber is cooled with a water-/air mist spray to prevent filament fusion.

Figure 5:
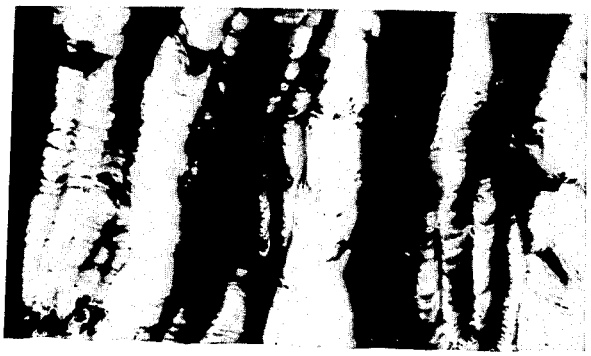
PRIOR ART Fig. 5
FIG. 5 is a photomicrograph of a prior art conventional stuffer box crimped cellulose acetate tow.
Figure 6:
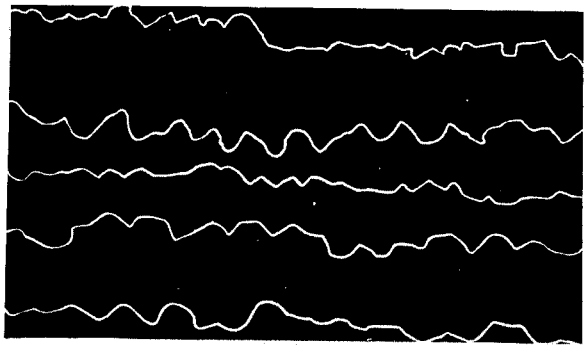
PRIOR ART Fig. 6
FIG. 6 is a photomicrograph of individual crimped filaments stripped from the tow of FIG. 5.

The crimped tow product which is illustrated in FIG. 5 of the drawings, the individual filaments of which are illustrated in FIG. 8 of the drawings, is found to have an average primary crimp of 19.6 crimps per inch and a coefficient of variation of 21.5.

As can be seen, the coefficient of variation of the primary crimp of the product produced by the process and apparatus of the instant invention as represented by Example I, is substantially less than the coefficient of variation of the primary crimp of the product produced by the process and apparatus of the prior art as represented by Example II.

Having thus disclosed the invention, what we claim is:

1. An improved stuffer box crimping apparatus having the ability to reduce crimp coefficient of variations in tow being crimped, said apparatus being of the type employing a pair of feed rolls having a bite therebetween and a rectangular cross-section crimping chamber off-set from the bite of said feed rolls, the improvement comprising forming substantially all of one wall of the crimping chamber from the arcuate surface of a pivoted doctor blade having a tip portion and a heel and the opposite wall from the rotating arcuate surface of one of the cylindrical feed rolls, said arcuate surface of said pivoted doctor blade substantially conforming to the curvature of said rotating surface forming said opposite wall of said crimping chamber, the rectangular cross-sectional area of the crimping chamber being of shallow depth and substantially constantly diminishing toward the exit portion thereof, said pivoted doctor blade having a convergence angle of from 20° to 45° and a heel contact angle of up to 80°, said pivoted doctor blade being pivotally mounted to that feed roll which is nearest the tip portion of said pivoted doctor blade, said arcuate surface of said feed roll being provided with a scraper blade positioned immediately beneath the heel of said pivoted doctor blade.

2. The apparatus of claim 1 wherein the diameter of one of said feed rolls is greater than the diameter of the other of said feed rolls.

3. The apparatus of claim 1 wherein the maximum depth of said crimping chamber is 0.003 to 0.3 inches.

4. The apparatus of claim 1 wherein said pivoted doctor blade has a radius of 0.250 to 3.50 inches.

5. The apparatus of claim 1 wherein said pivoted doctor blade has a heel radius of 0.01 to 0.50 inches.

6. A method of crimping a bundle or tow of continuous filaments with crimp coefficient of variation reduction, said method comprising feeding said bundle or tow of continuous filaments through the nip of a set of rotating cylindrical feed rolls into a shallow depth crimping chamber, one wall of which is formed by the arcuate surface of a doctor blade having a tip portion and a heel pivotally mounted to that feed roll which is nearest to the tip portion of said pivoted doctor blade and positioned to fit closely into the nip of said feed rolls and the opposite wall of which is formed by the rotating cylindrical surface of one of the rolls, said arcuate surface of said pivoted doctor blade substantially conforming to the curvature of said rotating cylindrical surface forming said opposite wall of said crimping chamber, said doctor blade having a convergence angle of from 20° to 45° and a heel contact angle of up to 80°, said doctor blade further operating to provide a back pressure within said crimping chamber to impede the movement of the continuous filament from said crimping chamber and causing the formation of a crimped tow which is then advanced along and out of said crimping chamber by the rotating cylindrical surface of that feed roll forming said opposite side of said crimping chamber, said crimped tow being released from said rotating cylindrical surface by a scraper blade positioned immediately beneath the heel of said pivoted doctor blade.

7. The method of claim 6 wherein said bundle or tow of continuous filaments is cellulose acetate continuous filaments.

8. The method of claim 6 wherein the volume of said crimping chamber varies to compensate for variations in the tow being crimped.

9. The method of claim 8 wherein said continuous filaments are cellulose acetate continuous filaments and wherein the coefficient of variation of the primary crimp of the crimped tow is not more than 10.

* * * * *